US006092804A

United States Patent [19]

Wingate

[11] Patent Number: 6,092,804

[45] **Date of Patent: *Jul. 25, 2000**

[54] APPARATUS FOR PREVENTING JAMS IN A FOLDER OF A PRINTING PRESS

[75] Inventor: Mark Anthony Wingate, Rochester, N.H.

[73] Assignee: Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/953,527

[22] Filed: Oct. 17, 1997

[51] Int. Cl.[7] ..... B65H 5/04

[52] U.S. Cl. ..... 271/276; 271/184; 270/4; 270/21.1; 270/47

[58] Field of Search ..... 271/276, 277, 271/300, 303, 184, 196, 197, 202, 82; 270/4, 6, 20.1, 21.1, 44, 47, 49

[56] References Cited

U.S. PATENT DOCUMENTS

| | | | |
|---|---|---|---|
| 3,921,968 | 11/1975 | Thomas et al. | 270/21.1 X |
| 4,299,325 | 11/1981 | Quinton et al. | 209/553 |
| 4,381,106 | 4/1983 | Loebach | 270/47 |
| 4,521,007 | 6/1985 | Darda . | |
| 5,427,368 | 6/1995 | Abe et al. | 271/283 |
| 5,484,379 | 1/1996 | Stab | 270/21.1 X |

*Primary Examiner*—Christopher P. Ellis
*Assistant Examiner*—Patrick Mackey
*Attorney, Agent, or Firm*—Kenyon & Kenyon

[57] ABSTRACT

An apparatus for preventing jams in a folder of a printing press includes a roller having vacuum holes to which vacuum pressure may be applied to attract the loosely constrained signature towards the roller. The signature will follow the curved path of the roller and be led away from a jam area of the printing press. When the printing press is running at normal operating speed (e.g., steady state), the vacuum is removed from the roller because the signatures will be guided by grippers and will then take a path through the printing press for further processing.

27 Claims, 5 Drawing Sheets

APPARATUS FOR PREVENTING JAMS IN A FOLDER OF A PRINTING PRESS

FIELD OF THE INVENTION

The present invention relates to a folder in a printing press, and more particularly to an apparatus for preventing jams in a folder of a printing press.

BACKGROUND INFORMATION

In the printing press field, particularly in rotary web-fed presses, a web is fed from a continuous roll of paper into the printing press. The web passes through various processing units, such as the infeed, print units, dryer, chill unit, folders, slitter, cutter, stacker, and other processing units as it is formed into signatures and then into the final printed product. Typically, the web is cut and folded during the processing of the product. After the web has been cut, the individual products are referred to as signatures. Signatures may be processed further by additional cutting and folding units. One particular process area, for example, is the collect cylinder and jaw cylinder nip.

Signatures may be fed into the collect cylinder (also referred to as a gripper and tucking blade cylinder or a transfer cylinder) and jaw cylinder nip by a tape drive system, as is known in the art, and described, for example, in co-pending application Ser. No. 08/645,855, which is incorporated in its entirety herein by reference. Tape drive systems typically include a number of tapes on each side of the product (e.g., signature) that are spaced longitudinally across driven rollers and that form a loop around the driven rollers, the rollers being driven by the collect cylinder circumference. The tapes contact a signature and provide a motive force to the signature on both sides by surface friction between the tape and the signature.

U.S. Pat. No. 4,521,007 describes a braking brush used in a folding apparatus of a rotary printing press that includes a puncturing or first product guiding cylinder which grips individual signatures and guides the signatures to a folding or second product guiding cylinder. The braking brush assembly of that patent uses braking brushes for stretching signatures which are conveyed in a given direction on the folding cylinder. The braking brushes are disposed individually at each folding cylinder, are curved to match the curvature of the folding cylinder, and are distributed over the length of the folding cylinder. The apparatus also includes a spindle and a cross bar extending transversely to the direction in which the signatures are conveyed. The braking brushes are movably fastened at a lower end to the spindle and at upper ends to the cross bar. Levers press the braking brushes to a greater or lesser extent selectively against the signatures conveyed on the cylinder.

During normal operation of a printing press, signatures may be fed through a tape drive mechanism and into a further processing nip such as a collect cylinder to jaw cylinder nip. However, at start-up, before the press is running at normal operating speeds (e.g., steady state), signatures in the tape drive mechanism do not travel in the same manner as when they travel at normal operating speed. Namely, a signature starting from rest or traveling at low speeds through the tape drive mechanism may not properly enter the further processing nip as the signature exits the tape drive mechanism. Improper travel of the signature (e.g., the lead edge is not under a gripper and thus is not guided to the next processing area) often results in paper jams which necessitate undesirable shutdown of the printing press. In addition, there is a certain amount of time (e.g., up to 30 seconds) required when the folder is seeking phase with respect to the printing unit. Each print unit has its own drive motor and the timing is established electronically. Any timing or phasing changes must be made gently so as not to break the web or ribbons.

An object of the present invention is to provide an apparatus that prevents jams in the folder apparatus during start-up or deceleration periods of press operation.

SUMMARY OF THE INVENTION

The present invention provides an apparatus for preventing jams in, for example, a folder of a printing press including a vacuum cylinder rotatably mounted in the folder having a longitudinal bore therethrough and a plurality of holes in the circumferential surface thereof, and a vacuum connection port, at least one tape drive traversing the vacuum cylinder.

An advantage of the present invention is that it can be adapted to existing transport systems through modification of existing components without the requirement of additional components, thus promoting and maintaining compactness of design. For example, the vacuum cylinder of the present invention can be an adaption of a roller already present in the folding apparatus, such as a conveyor tape roller.

The apparatus according to the present invention provides for removal of signatures from the folding apparatus which would otherwise cause a signature jam in, for example, the product transfer area from a tape drive mechanism to a cylinder processing nip. For example, during start-up, loosely restrained signatures are not positively held by grippers on the processing cylinder of the folder, such as the collect cylinder. Because a continuous stream of signatures is delivered to the product transfer area of the folder, signatures not correctly transferred must be conveyed out of the product transfer area to prevent jamming of the signature stream. The present invention accomplishes that result by providing a vacuum cylinder which guides loose signatures out of the transfer area to prevent bunching and jamming of the signatures.

DETAILED DESCRIPTION OF THE INVENTION

Figure 1:
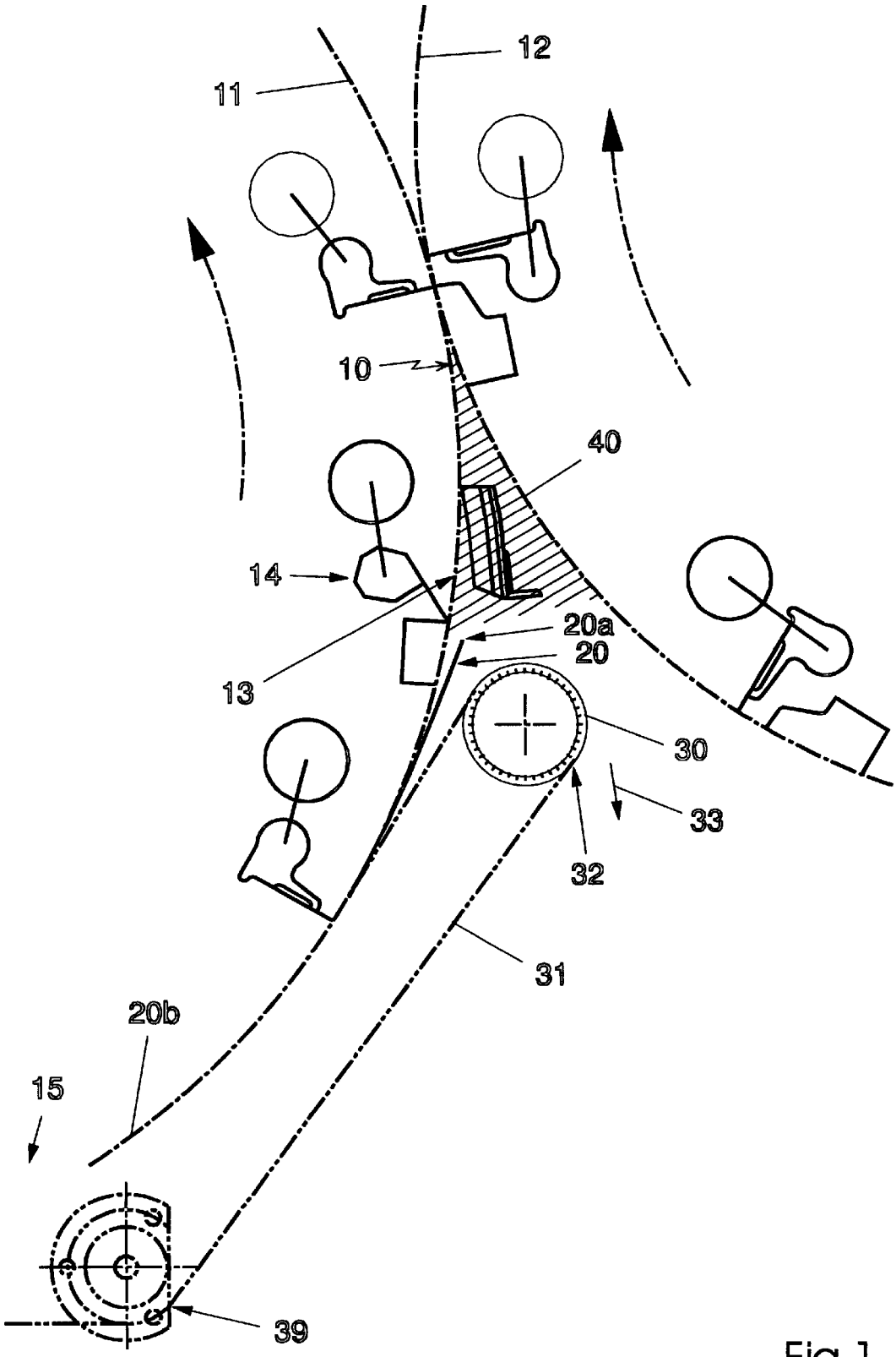
FIG. 1 is a representational side view of a tape drive to processing nip transfer area of a printing press according to the present invention.

FIG. 1 shows a transfer area of a printing press. A processing nip 10 of a printing press is formed between two processing cylinders 11 and 12, for example, a collect cylinder 11 and a jaw cylinder 12. Collect cylinder 11 is also referred to as a gripper and tucking blade cylinder or transfer cylinder. As is known in the art, signature 20 travels between the surface of collect cylinder 11 and tapes 31 of a conventional tape drive mechanism into the transfer area 13.

When the printing press is running at normal operating speeds (e.g., steady state), a gripper 14 of the collect cylinder 11 grips signature 20 in a gripper action area 15 which interacts with the tapes 31 and leads the signature 20 past a guide member 40, which is shown in the present embodiment as, for example, a brush. The guide member or brush 40 serves to guide and to maintain control of the signature 20 to properly process the signature 20 in the processing cylinders 11 and 12.

Rotation of the collect cylinder 11 is timed to provide a gripper 14 corresponding to the delivery of the lead edge of the signature 20. Adjustment may be necessary to correlate the lead edge of the signature 20 and the gripper 14 at start-up. The gripper 14 maintains positive control of the lead edge of the signature 20 and carries the signature 20 to the fold off or processing area. However, the signatures 20 are left in the printing press when the press is stopped and therefore are "loose" at the next start-up of the printing press.

At start-up, the printing press must pass through a start-up period when the folder is, for example, not running at normal operating speeds (e.g., during phasing, while processing wrinkled signatures, or when under low tension), and further, may experience slow down periods, for example, when complications in press operations arise, such as a web break. During these periods of operation, a signature 20 may not be properly gripped by the gripper 14 of collect cylinder 11. In such a circumstance, the signature 20 becomes a loose signature and is not led through the guide member 40 and into the nip 10 of the processing cylinders 11 and 12. Instead, for example, the signature 20 is misaligned and can jam in the transfer area 13. For example, the lead end 20*a* of a signature 20 may collide with the brush 40 while the trailing end 20*b* of signature 20 continues to be transported between tapes 31 and collect cylinder 11. This may cause the signature 20 to bunch up and jam the transfer area 13 preceding the nip 10.

Particularly during start-up of a rotary printing press, the signatures 20 tend to be loosely restrained. The signatures 20 are held against the surface of the cylinder by, for example, tapes 31 but not by the gripper 14. Therefore, when the signatures 20 reach the point in the transfer area 13 where the tape 31 traverses around the exit or vacuum cylinder 30 and away from the processing cylinder 11, the tape 31 will no longer hold the signatures 20 against the cylinder 11. Since the signatures 20 may not restrained by a gripper 14 on the cylinder 11, the lead end 20*a* of a signature 20 could be loose within the product transfer area 13 and may not be guided past the brush member 40. Rather, the signature 20 may undesirably jam into the brush 40. Because a continuous flow of signatures is being provided to product transfer area 13, even during start-up, the loose signatures 20 can bunch up and therefore cause a jam in the product transfer area 13.

Figure 2:
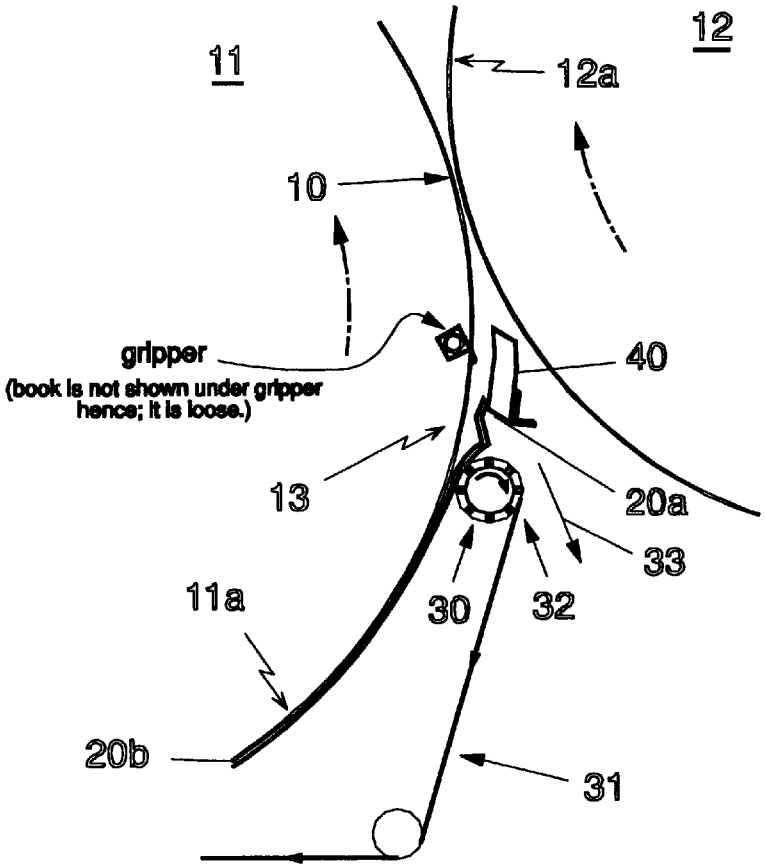
FIG. 2 is a side view of a tape drive mechanism showing a signature jamming in the transfer area.
Figure 2:
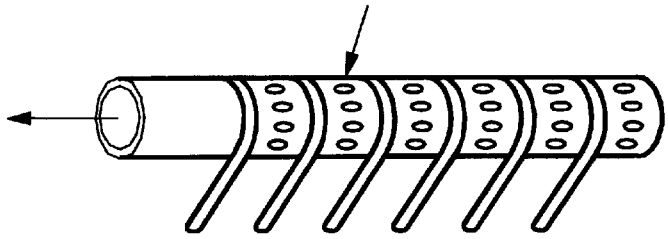

FIG. 2 illustrates jamming of signatures 20 in the product transfer area 13. The lead end 20*a* of a loosely held signature 20 tends to, for example, catch on the guide or brush 40 in product transfer area 13. The signature 20, caught on the brush 40, bunches and jams in the transfer area 13. The condition worsens as cylinder 11 continues to rotate and deliver more signatures 20 into the transfer area 13. It is also possible that, for example, a plurality of signatures or other printed products could become dislodged or accumulate during transportation and then pass through the cylinder nip at the transfer area 13. Such a circumstance could, for example, create a significant crushing force in the nip causing severe damage to the cylinder components, such as a buckling of the cylinder shell.

The apparatus of the present invention, however, prevents a jam condition by directing loosely constrained signatures 20 out of the transfer area so that they do not become bunched. For example, by applying a vacuum pressure to the exit or vacuum cylinder 30, generally timed to correspond with start-up of the printing press, a loose or non-guided signature 20 is attracted to the vacuum cylinder 30. The signature 20 is thereby induced to follow the curvature of the vacuum cylinder 30. As a result, signature 20 is directed away from the potential jam site, as indicated by arrow 33 in FIG. 1, to a clearing area. Prudent design of the press should allow proper travel of the signature 20 once it has been routed around the vacuum cylinder 30 to a clearing area and away from the transfer area 13. For example, one possible solution is to keep the re-routed region, or clearing area, free of impediments so that the signature 20 can be stripped from the vacuum roll 30 by tapes 31 and fall harmlessly to the floor without jamming other areas of the press.

Figure 3:
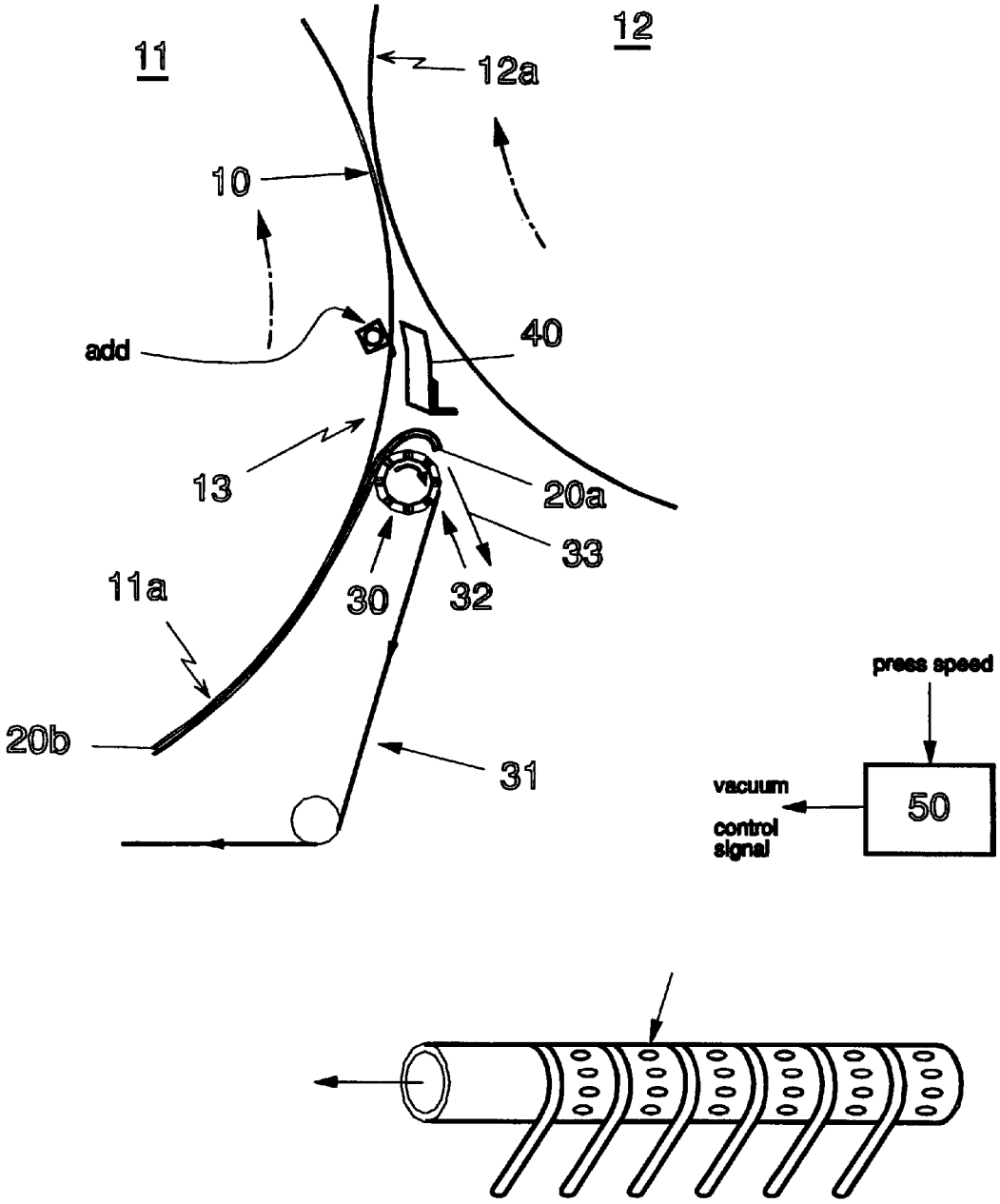
FIG. 3 is a side view of an embodiment of the present invention showing a loose signature being guided away from the transfer area according to the present invention.

FIG. 3 shows a product transfer area 13 within a folding apparatus which, by operation of the vacuum cylinder 30 of the present invention, shows a loose signature 20 being directed away from the transfer area 13 to prevent jamming. Two cooperating process cylinders 11 and 12—such as a collect cylinder 11, a jaw cylinder 12, or the like—form a nip in the region of the product transfer area 13 in which products or signatures 20 are transferred from a surface 11*a* of the first processing cylinder 11 to a respective surface 12*a* of the second processing cylinder 12. Within the product transfer area 13 is located the vacuum cylinder 30 according to the present invention. The vacuum cylinder 30 can be, for example, a roller which guides high-speed conveyor tape 31 assigned to the surface 11*a* of the first processing cylinder 11.

Figure 4:
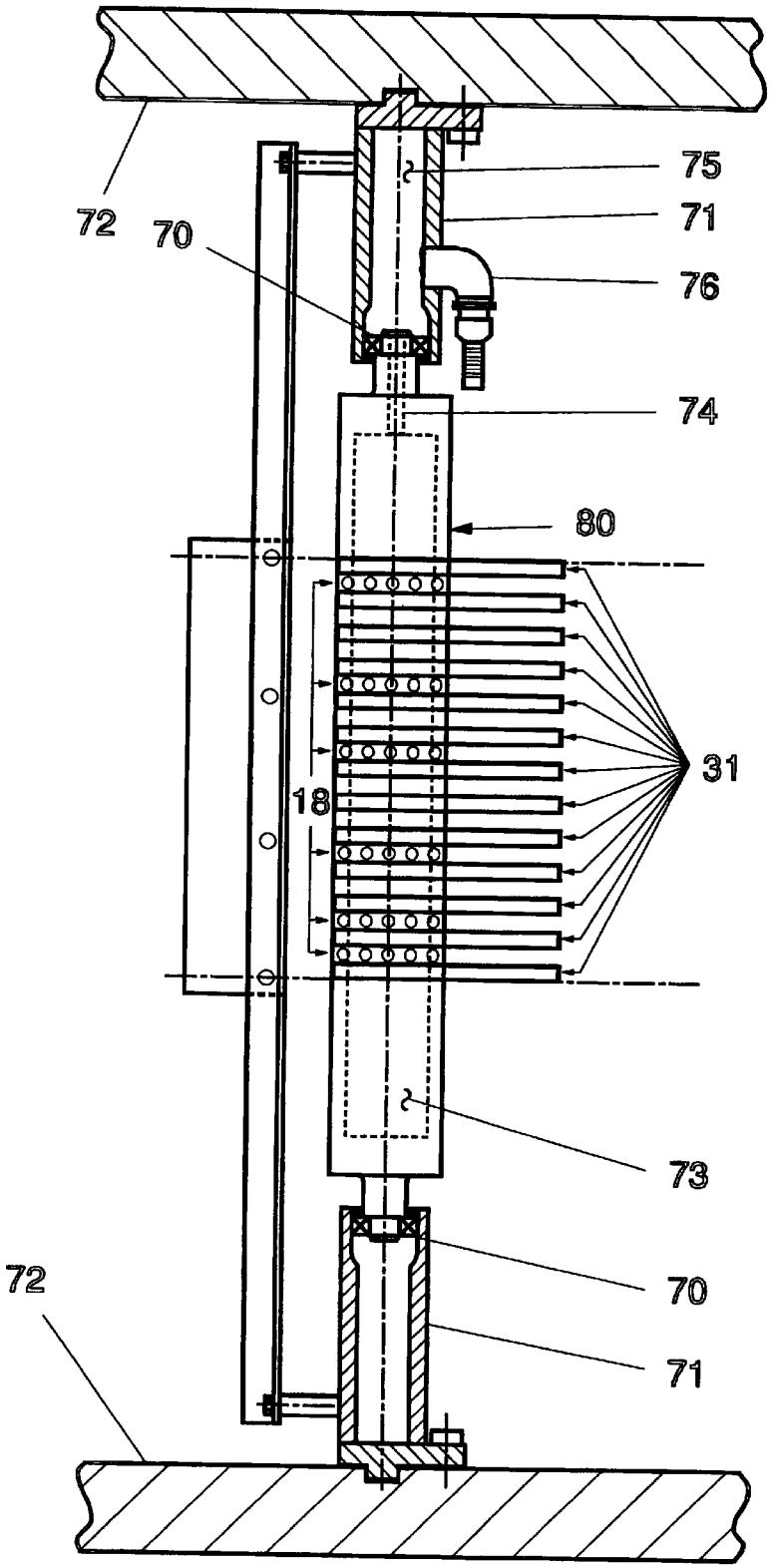
FIG. 4 shows a front view of a vacuum cylinder according to an embodiment of the present invention.

FIG. 4 shows an exemplary vacuum cylinder 30 according to the present invention. The vacuum cylinder 30 is rotatably mounted on bearings 70 to mount members 71 connected to the frame 72 of a printing press P. The vacuum cylinder 30 has, for example, a bore 73 in its interior with a passage 74 connecting the bore 73 to at least one of the mount members 71. At least one of the mount members 71 also has, for example, an internal bore 75 and further includes a fitting 76 to which a vacuum means (not shown) may be attached. The exterior surface 80 of the vacuum cylinder 30 may be adapted to accommodate a plurality of tapes 31 spaced across a length of the vacuum cylinder 30. The vacuum cylinder 30 further includes a plurality of holes 81 extending from the surface of the vacuum cylinder 30 into and in fluid communication with the bore 73 of the vacuum cylinder 30. The holes 81 are spaced along the length of the vacuum cylinder 30 in cooperation with the tapes 31 and, for example, can be spaced circumferentially with a substantially equal distribution to provide adequate vacuum around the circumference of the vacuum cylinder 30.

The vacuum pressure means (not shown) that is attached to the fitting 76 of the cylinder mount 71 may be, for example, switchable on and off. When the vacuum pressure is applied, for example during start-up of the printing press, a vacuum suction is created at the holes 81 on the surface of the vacuum cylinder 30. The vacuum suction attracts loose signatures 20 to the surface of the vacuum cylinder 30 so that the signatures are routed away from the transfer area 13 as shown in FIG. 3 As the vacuum cylinder 30 rotates, the signature 20 wraps around the vacuum cylinder 30 traveling away from the transfer area 13.

If the signature 20 remains attached to the vacuum cylinder, the tapes 31 will eventually separate the signature 20 from the vacuum cylinder 30 because, for example, the tapes 31 take a path tangent to the vacuum cylinder 30 at the separation point 32. The separation point 32 is geometrically determined, for example, by the location of an adjacent roller 39 of the tape drive mechanism, to which the tapes 31 traverse after leaving the vacuum cylinder 30. When the loose signature 20 is led away from the transfer area 13, it may simply be directed away from press components so that it may, for example, freely fall to the floor, clear of problematic entanglements with other components.

Figure 5:
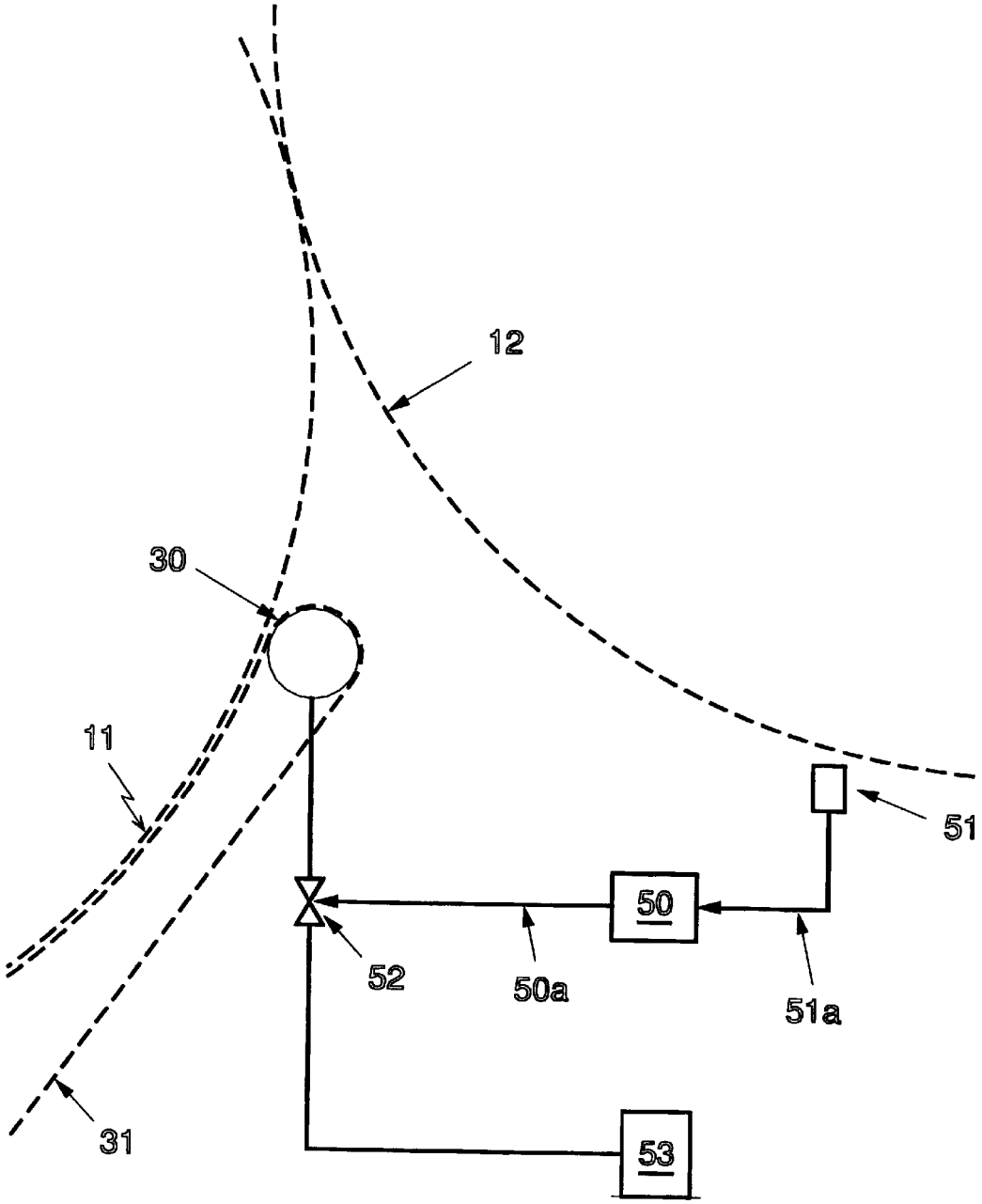
FIG. 5 is a side view of an embodiment of the present invention including a vacuum cylinder control mechanism.

As described earlier, jamming of loose signatures 20 is often associated with start-up and deceleration periods of press operation. Therefore, vacuum pressure may, for example, be applied to the vacuum cylinder 30 by a control mechanism 50, such as illustrated in FIG. 5, which outputs a control signal based on the speed at which the press is operating. FIG. 5 shows an exemplary embodiment of a control system that can be used to control the vacuum pressure of the vacuum cylinder 30. A speed sensor 51 monitors an appropriate component of the press, such as processing cylinder 12, and provides a signal 51*a*, corresponding to the speed of the component, to a control unit 50. The control unit 50, such as a microprocessor based control device, processes the signal 51*a* and provides a control signal 50*a* to, for example, a solenoid valve 52. The solenoid valve 52 is opened to provide a path from the vacuum cylinder 30 to the vacuum pressure means 53, such as a vacuum tank and vacuum pump assembly. When the speed sensor 51 provides a signal indicating sufficient operating speed, control signal 50*a* from the control unit 50 closes the solenoid valve and the vacuum pressure is thereby removed from the vacuum cylinder 30. The vacuum cylinder 30 may then operate as a conventional tape exit roll.

Alternative control systems can be easily envisaged, such as a system in which a control signal is used to turn a vacuum pump on and off rather than merely opening and closing a valve.

While the present invention is capable of various modifications and alternate constructions, it is not intended to limit the invention to the specific embodiments disclosed herein. Rather, it is intended to cover all modifications and alternative constructions falling within the spirit and scope of the invention as expressed in the claims.

What I claim is:

1. An apparatus for preventing signatures from jamming in a printing press, comprising:

a vacuum cylinder rotatably mounted in the printing press, the vacuum cylinder having a plurality of holes in a circumferential surface of the vacuum cylinder, the plurality of holes being in fluid communication with a vacuum source;

a first processing cylinder rotatably mounted in the printing press, the first processing cylinder being substantially parallel to the vacuum cylinder, the first processing cylinder adapted to receive and process signatures one at a time; and a tape drive mechanism having at least one conveyor tape passing around a surface of the vacuum cylinder, the tape drive mechanism transporting a signature along a surface of the first processing cylinder and towards the vacuum cylinder, the signature following a contour of the vacuum cylinder when the vacuum source is in an operative state to prevent a jamming condition.

2. The apparatus according to claim 1, wherein when the vacuum cylinder is in the operative state, a vacuum pressure applied to the vacuum cylinder via the vacuum source attracts the signature towards the vacuum cylinder surface so that the signature is routed towards a clearing area, and when the vacuum cylinder is in a non-operative state, a vacuum pressure is not applied to the vacuum cylinder so that the signature is routed towards a transfer area of the printing press.

3. The apparatus according to claim 1, wherein the vacuum cylinder includes a conveyor tape roller of the tape drive mechanism.

4. The apparatus according to claim 1, wherein the first processing cylinder includes a collect cylinder.

5. The apparatus according to claim 1, further comprising a control system disposed between the vacuum cylinder and the vacuum source to control a vacuum pressure applied to the vacuum cylinder.

6. The apparatus according to claim 5, wherein the control system generates a control signal for controlling the vacuum source, the control signal being a function of a speed of the printing press.

7. The apparatus according to claim 1, further comprising a second processing cylinder rotatably mounted in the printing press substantially parallel to the first processing cylinder and forming a nip therebetween, the tape drive mechanism transporting the signature toward the nip.

8. The apparatus according to claim 1, wherein the vacuum source includes a vacuum tank and a vacuum pump assembly.

9. The apparatus according to claim 5, wherein the control system controls a solenoid valve connected to the vacuum cylinder and to the vacuum source.

10. The apparatus according to claim 1, wherein the vacuum cylinder, the first processing cylinder and the tape drive mechanism are disposed in a folder unit of a printing press.

11. The apparatus according to claim 2, wherein the first processing cylinder includes a gripper element gripping the signature, the signature being routed towards the transfer area via the gripper element.

12. The apparatus according to claim 1, wherein the operative state occurs during a start-up period of the printing press.

13. The apparatus according to claim 2, wherein the non-operative state occurs during a steady state operation of the printing press.

14. An method for preventing signatures from jamming in a printing press, comprising:

providing a exit cylinder rotatably mounted in the printing press, a first processing cylinder rotatably mounted in the printing press, and a tape drive mechanism having at least one conveyor tape passing around a surface of the exit cylinder;

transporting signatures between a surface of the first processing cylinder and the tape drive mechanism;

directing selected signatures along a contour of the exit cylinder and away from the surface of the first processing cylinder to prevent a jamming condition.

15. The method according to claim 14, wherein the selected signatures are routed towards a clearing area, and other signatures are routed towards a transfer area of the printing press.

16. The method according to claim 14, further comprising applying a vacuum to the selected signatures to direct the selected signatures away from the surface of the first processing cylinder.

17. The method according to claim 16, further comprising controlling the vacuum applied to the signatures.

18. The method according to claim 17, wherein the vacuum is controlled as a function of a speed of the printing press.

19. The method according to claim 14, further comprising providing a second processing cylinder rotatably mounted in the printing press substantially parallel to the first processing cylinder and forming a nip therebetween; and transporting the signatures toward the nip.

20. The method according to claim 14, further comprising providing gripper elements on the first processing cylinder and gripping the signatures with the gripper elements.

21. The method according to claim 14, wherein all of the signatures are directed along the contour of the exit cylinder during a start-up period of the printing press, and further wherein none of the signatures are directed along the contour of the exit cylinder during a steady-state operation of the printing press.

22. The apparatus according to claim 2, further comprising a controller controlling the vacuum source, the controller being adapted to place the vacuum source in an operative state during the entire duration of a start-up period of the printing press.

23. The apparatus according to claim 22, wherein the controller is adapted to place the vacuum source is a non-operative state during the entire duration of a steady-state operation of the printing press.

24. The method according to claim 16, further comprising the steps of:

monitoring a speed of the printing press; and controlling the vacuum with a controller, the controller being responsive to the monitored speed of the processing cylinder.

25. The method according to claim 24, wherein the step of monitoring the speed of the printing press is accomplished by monitoring a speed of the processing cylinder.

26. The method according to claim 24, wherein when the monitored speed is above a preset speed, the controller shuts off the vacuum.

27. The method according to claim 24, wherein when the monitored speed is below a preset speed, the controller applies the vacuum to the signatures so that the signatures are routed toward a clearing area.

* * * * *